US009863085B2

(12) United States Patent
Shin et al.

(10) Patent No.: US 9,863,085 B2
(45) Date of Patent: Jan. 9, 2018

(54) LAUNDRY MACHINE

(71) Applicant: LG ELECTRONICS INC., Seoul (KR)

(72) Inventors: Yongho Shin, Seoul (KR); Sangik Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 384 days.

(21) Appl. No.: 14/137,167

(22) Filed: Dec. 20, 2013

(65) Prior Publication Data

US 2014/0182159 A1 Jul. 3, 2014

(30) Foreign Application Priority Data

Dec. 31, 2012 (KR) ..... 10-2012-0157981

(51) Int. Cl.
*D06F 58/04* (2006.01)
*D06F 58/10* (2006.01)
*D06F 58/20* (2006.01)

(52) U.S. Cl.
CPC ..... *D06F 58/04* (2013.01); *D06F 58/10* (2013.01); *D06F 58/20* (2013.01)

(58) Field of Classification Search
CPC ..... D06F 58/04; D06F 58/10; D06F 58/20
See application file for complete search history.

(56) References Cited

U.S. PATENT DOCUMENTS 6,324,771 B1 * 12/2001 McAllister ..... D06F 58/02 34/595
7,765,715 B2 * 8/2010 Kim ..... D06F 58/28 34/491
2004/0221474 A1 11/2004 Slutsky et al.

FOREIGN PATENT DOCUMENTS

| | | | |
|---|---|---|---|
| CN | 102782206 | A | 11/2012 |
| DE | 3918560 | A1 | 12/1990 |
| DE | 4028600 | A1 | 3/1992 |
| DE | 19623959 | A1 | 12/1997 |
| EP | 1559827 | A1 | 8/2005 |
| EP | 2604746 | A1 | 6/2013 |
| KR | 10-2005-0029774 | A | 3/2005 |
| KR | 10-2008-0032361 | A | 4/2008 |

* cited by examiner

*Primary Examiner* — Jessica Yuen
(74) *Attorney, Agent, or Firm* — Dentons US LLP

(57) ABSTRACT

A laundry machine is disclosed. The laundry machine is provided with a discharge part arranged in a drum not only to cause movement of the laundry in the drum but also to directly supply, to the laundry, the air supplied to the drum through an air supply unit when the drum rotates.

9 Claims, 3 Drawing Sheets

LAUNDRY MACHINE

Pursuant to 35 U.S.C. §119(a), this application claims the benefit of Korean Patent Application No. 10-2012-0157981, filed on Dec. 31, 2012, which is hereby incorporated by reference as if fully set forth herein.

BACKGROUND OF THE INVENTION

Field of the Invention

The present invention relates to a laundry machine.

Discussion of the Related Art

"Laundry machine" is a general term referring to home appliances including washing machines having only a washing function of washing clothing, dryers having only a drying function, and machines having both washing and drying functions.

Laundry machines capable of drying clothes supply high-temperature air (hot air) to the laundry, and can be classified into an exhaust type and a circulation (or condensation) type depending on how air flows through the machine.

The circulation type laundry machine circulates air in a laundry accommodating space storing the laundry by removing moisture from the air (i.e., dehumidifying the air) discharged from the laundry accommodating space, heating the air, and then re-supplying the air to the accommodation space.

The exhaust type laundry machine supplies heated air to the laundry accommodating space, but discharges the air discharged from the laundry accommodating space from the laundry machine instead of circulating the air.

A hot air supply device provided to a conventional laundry machine supplies hot air to the laundry accommodating space from the rear side thereof. Accordingly, in a conventional laundry machine, the hot air exchanges heat with the laundry while the air introduced into the rear side of the laundry accommodating space moves to the front side of the laundry accommodating space.

In the case of the conventional laundry machine, when the amount of laundry is large, heat exchange may smoothly occur between the laundry and the air introduced into the laundry accommodating space from the rear side. However, when the amount of the laundry is small, drying efficiency may be degraded.

That is, in the case that a large amount of laundry is accommodated in the laundry accommodating space, the laundry does not frequently contact the inner circumferential surface of the laundry accommodating space when the laundry accommodating space is rotated, and thus the laundry can be easily dried. However, in the case that the amount of the laundry is small, some of the laundry may remain closely contacting the inner circumferential surface of laundry accommodating space even when the laundry accommodating space is rotated to tumble the laundry. Thereby, drying is not easily implemented.

SUMMARY OF THE INVENTION

Accordingly, the present invention is directed to a laundry machine that substantially obviates one or more problems due to limitations and disadvantages of the related art.

An object of the present invention is to provide a laundry machine that has a high drying efficiency.

Another object of the present invention is to provide a laundry machine provided with a discharge part arranged in a drum accommodating laundry not only to cause movement of the laundry but also to spray air toward the laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine including a cabinet provided with an introduction hole for introducing and retrieving laundry, a drum configured to store the laundry introduced through the introduction hole and to be rotatable in the cabinet, an air supply unit to supply air to the drum, a discharge part to discharge the air supplied by the air supply unit from a circumferential surface of the drum toward a center of rotation of the drum, or from the circumferential surface of the drum in a circumferential direction of the drum.

The discharge part may be a flow passage arranged in a longitudinal direction of the drum and fixed to the circumferential surface of the drum, the flow passage protruding from the circumferential surface of the drum toward the center of rotation of the drum.

The flow passage may be a lifter to move the laundry stored in the drum when the drum rotates.

The lifter may include a cover plate fixed to a rear surface of the drum to spray the air supplied from the air supply unit toward a front surface of the drum, and at least one arm communicating with the cover plate and fixed to the circumferential surface of the drum to discharge the air introduced into the cover plate from the circumferential surface of the drum toward the center of rotation of the drum, or from the circumferential surface of the drum in the circumferential direction of the drum.

The cabinet further may include an air supply hole allowing the air supplied from the air supply unit to be introduced thereinto, the air supply unit may include a discharge duct allowing the air to be discharged from the drum therethrough, a supply duct connected to the air supply hole, a fan provided to the discharge duct do discharge the air from the drum, and a heat exchanger provided to the supply duct to heat air, and the drum may include a through hole formed in the rear surface of the drum and communicating with the cover plate, and a flow passage connection part connecting the air supply hole to the through hole.

The cabinet may further include an air supply hole allowing the air supplied from the air supply unit to be introduced thereinto, the air supply unit may include a discharge duct allowing the air to be discharged from the drum therethrough, a supply duct having one end connected to the discharge duct and the other end connected to the air supply hole, a heat exchanger to dehumidify and heat the air introduced into the discharge duct, and a fan to circulate the air in the drum, and the drum may include a through hole formed in the rear surface of the drum and communicating with the cover plate, and a flow passage connection part connecting the air supply hole to the through hole.

The cover plate may include a cover through hole arranged to surround the through hole to supply the air introduced through the through hole toward the front surface of the drum, and the arm may include an arm through hole to discharge the air supplied from the cover plate to the center of rotation of the drum.

The cover plate may include a cover through hole arranged to surround the through hole to supply the air introduced through the through hole toward the front surface of the drum, and the arm may include an arm through hole to discharge the air supplied from the cover plate in the circumferential direction of the drum.

The cover plate and the arm may be detachable from and attachable to each other.

The cover plate and the arm may be integrally provided to the drum.

A plurality of arms of the at least one arm may be arranged spaced 120 degrees apart from each other on the circumferential surface of the drum.

The lifter may include a cover plate fixed to a rear surface of the drum to spray the air supplied from the air supply unit toward a front surface of the drum, and at least one arm communicating with the cover plate and fixed to the circumferential surface of the drum to discharge the air introduced into the cover plate from the circumferential surface of the drum toward the center of rotation of the drum and in the circumferential direction of the drum.

The cabinet further may include an air supply hole allowing the air supplied from the air supply unit to be introduced thereinto, the air supply unit may include a discharge duct allowing the air to be discharged from the drum therethrough, a supply duct connected to the air supply hole, a fan provided to the discharge duct do discharge the air from the drum, and a heat exchanger provided to the supply duct to heat air, and the drum may include a through hole formed in the rear surface of the drum and communicating with the cover plate, and a flow passage connection part connecting the air supply hole to the through hole.

The cabinet may further include an air supply hole allowing the air supplied from the air supply unit to be introduced thereinto, the air supply unit may include a discharge duct allowing the air to be discharged from the drum therethrough, a supply duct having one end connected to the discharge duct and the other end connected to the air supply hole, a heat exchanger to dehumidify and heat the air introduced into the discharge duct, and a fan to circulate the air in the drum, and the drum may include a through hole formed in the rear surface of the drum and communicating with the cover plate, and a flow passage connection part connecting the air supply hole to the through hole.

The cover plate may include a cover through hole arranged to surround the through hole to supply the air introduced through the through hole toward the front surface of the drum, and the arm may include an arm through hole to discharge air toward the center of rotation of the drum, and an arm through hole to discharge the air in the circumferential direction of the drum.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The configuration or control method of the apparatus described hereinafter is intended only to illustrate embodiments of the present invention and not to limit the scope of the present invention. The accompanying drawings illustrate an example of the circulation type laundry machine. However, the present invention is also applicable to an exhaust type laundry machine.

Figure 1:
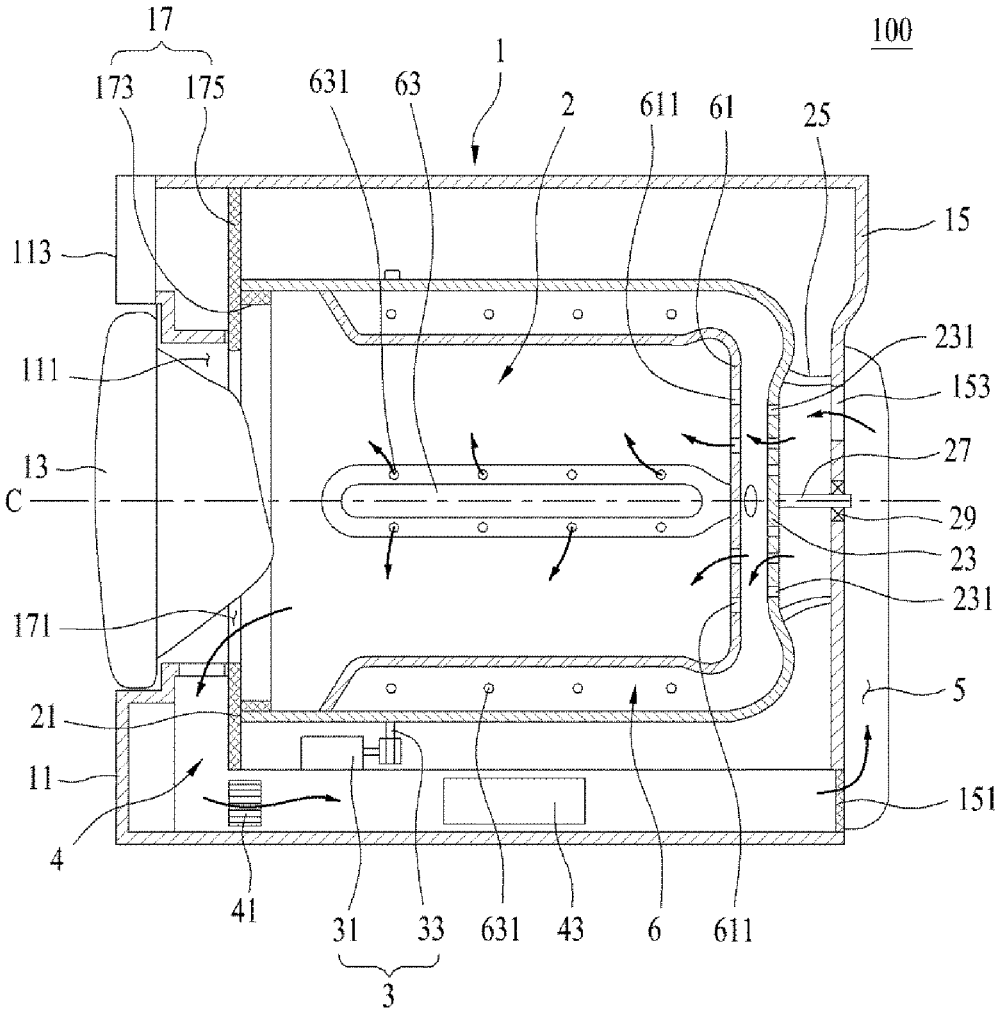
FIG. 1 is a view illustrating a laundry machine according to one embodiment of the present invention.

As shown in FIG. 1, the laundry machine 100 includes a cabinet 1 forming an external appearance of the laundry machine 100, a drum 2 rotatably arranged in the cabinet to accommodate laundry such as clothing, an air supply unit 4 and 5 to supply air (heated air or non-heated air), and a discharge part 6 provided to the drum to supply the air, provided by the air supply unit 4 and 5, from the circumferential surface of the drum toward the center of rotation of the drum or in the circumferential direction of the drum.

The cabinet 1 includes a front panel 11 and a rear panel 15, which form the front surface and rear surface of the laundry machine.

The front panel 11 is provided with an introduction hole 111 for introducing and retrieving laundry. The introduction hole 111 is opened and closed by a door 13 rotatably provided to the front panel 11.

The front panel 11 may be further provided with a control panel 113 having a means to indicate inputs of control commands of the laundry machine 100 and details of control.

The air supply unit may include a discharge duct 4 and a supply duct 5. The rear panel 15 is provided with an air discharge hole 151 allowing the air discharged from the discharge duct 4 to flow into the supply duct 5, and an air supply hole 153 connected to the supply duct 5.

Provided in the cabinet 1 is a drum supporter 17 to support the front surface of the drum 2. The drum supporter 17 may include a supporter body 175 fixed to the interior of the cabinet, a supporter introduction hole 171 arranged passing through the supporter body 175 and communicating with the introduction hole 111, and a flange 173 by which the front surface of the drum is rotatably supported.

In this case, the flange 173 is preferably arranged along the outer circumferential surface of the supporter introduction hole 171 to support an opening 21 of the drum 2.

The drum 2 may be formed in the shape of a cylinder having an open front surface. In this case, the front surface is provided with a drum opening 21 for introducing and retrieving the laundry.

As described above, the drum opening 21 is rotatably coupled to the flange 173 of the drum supporter 17.

The rear surface 23 of the drum 2 is provided with a plurality of through holes 231 allowing the air introduced through the air supply hole 153 to move into the drum 2 therethrough.

The through holes 231 are arranged passing through the rear surface 23 of the drum. The rear surface 23 of the drum may be further provided with a flow passage connection part 25 connecting the through holes 231 to the air supply hole 153.

As shown in FIG. 1, the flow passage connection part 25 may be fixed to the rear surface 23 of the drum to rotate together with the drum when the drum rotates, or may be fixed to the rear panel 15 of the cabinet.

In any cases, the flow passage connection part 25 needs to guide the air discharged from the air supply hole 153 to the through holes 231.

FIG. 1 illustrates the flow passage connection part 25 having a tubular shape and fixed to the rear surface 23 of the drum. In the illustrated embodiment, one end of the flow passage connection part 25 is fixed to the rear surface 23 to surround the through holes 231, and the other end thereof (the free end) of the flow passage connection part 25 maintains contact with the rear panel 15, surrounding the air supply hole 153.

Accordingly, the laundry machine 100 can supply the air (heated air or non-heated air) discharged from the air supply hole 153 to the drum 2 through the flow passage connection part 25.

In the case that the flow passage connection part 25 is provided to the rear surface 23 of the drum, the free end of the flow passage connection part preferably contacts the rear panel 15. In the case that the flow passage connection part 25 is fixed to the rear panel 15, the free end of the flow passage connection part 25 preferably contacts the rear surface 23 of the drum. Accordingly, the flow passage connection part 25 is preferably formed of a material having high wear resistance.

Meanwhile, the rear surface 23 of the drum is further provided with a shaft 27 to rotatably support the rear surface 23 of the drum on the rear panel 15.

As shown in FIG. 1, one end of the shaft 27 may be fixed to the rear surface 23 of the drum and the other end thereof may be rotatably supported on the rear panel 15 through a bearing 29.

Accordingly, the drum 2 of the illustrated embodiment may be rotatably supported within the cabinet 1 through the flange 173 of the drum supporter 17 and the shaft 27.

Unlike the embodiment shown in FIG. 1, one end of the shaft 27 may be fixed to the rear panel 15, and the other end thereof may be rotatably supported by the rear surface 23 of the drum.

The drum 2 is rotated by a drive unit 3. The drive unit 3 may include a motor 31 located outside the drum, and a belt 33 connecting the shaft of the motor 31 to the outer circumferential surface of the drum 2.

In the case that the laundry machine 100 is a circulation type laundry machine, the air supply unit may include a discharge duct 4 adapted to discharge the air from the drum 2 and connected to the air discharge hole 151 provided in the rear panel 15, and a supply duct 5 having one end connected to the discharge duct 4 through the air discharge hole 151 and the other end connected to the air supply hole 153 provided in the rear panel 15.

In this case, the air supply unit preferably includes a fan 41 to discharge the air from the drum and a heat exchanger 43 to dehumidify and heat the air discharged from the drum.

The fan 41 and the heat exchanger 43 may be provided in the discharge duct 4 or may be provided in the supply duct 5. Alternatively, the fan 41 and the heat exchanger 43 may be respectively provided in the discharge duct 4 and the supply duct 5.

The heat exchanger 43 may be provided with a heat pump, and the fan 41 may be rotated by the motor 41 of the drive unit.

That is, in the case that the motor 31 is a double shaft motor having two shafts, one of the shafts may be connected to the belt 33, and the other one may be arranged to rotate the fan 41.

In the case that the laundry machine 100 is an exhaust type laundry machine, the air supply unit may be provided with a discharge duct connecting the drum 2 to the air discharge hole 151 to discharge the air in the drum to an outside of the cabinet 1, and a supply duct to supply external air from the outside of the cabinet 1 to the drum 2.

In this case, the discharge duct may need to be provided with a fan to discharge the air from the drum, and the supply duct may need to be provided with a heat exchanger (a heater) to heat the air.

The drum 2 is provided therein with a discharge part 6 communicating with the air supply unit and fixed to the drum. The discharge part 6 discharges the air, provided by the air supply unit, from the circumferential surface of the drum (the surface extending from the rear surface of the drum toward the drum opening) toward the center of rotation C of the drum or the circumferential surface of the drum.

The discharge part 6 may have a various form so long as it can supply air toward the center of rotation of the drum or in the circumferential direction of the drum by being arranged in the longitudinal direction of the drum and fixed to the circumferential surface of the drum as a flow passage. FIG. 1 shows a lifter protruding from the circumferential surface of the drum toward the center of rotation of the drum as an example of the discharge part 6.

Accordingly, when the drum rotates, the discharge part 6 not only causes the laundry stored in the drum to move, but also supplies air even to the laundry closely contacting the circumferential surface of the drum.

That is, since the discharge part (hereinafter, referred to as lifter 6) provided in this embodiment is capable of supplying air from the circumferential surface of the drum 2 toward at least one of the center of rotation (C or D1 of FIG. 2) of the drum and the circumference of the drum, air may be supplied to the laundry introduced into the drum even when the amount of the laundry is small and thus part of the laundry closely contacts the inner circumferential surface of the drum.

Therefore, the laundry machine provided with the lifter 6 may increase energy efficiency in addition to drying efficiency.

Figure 2:
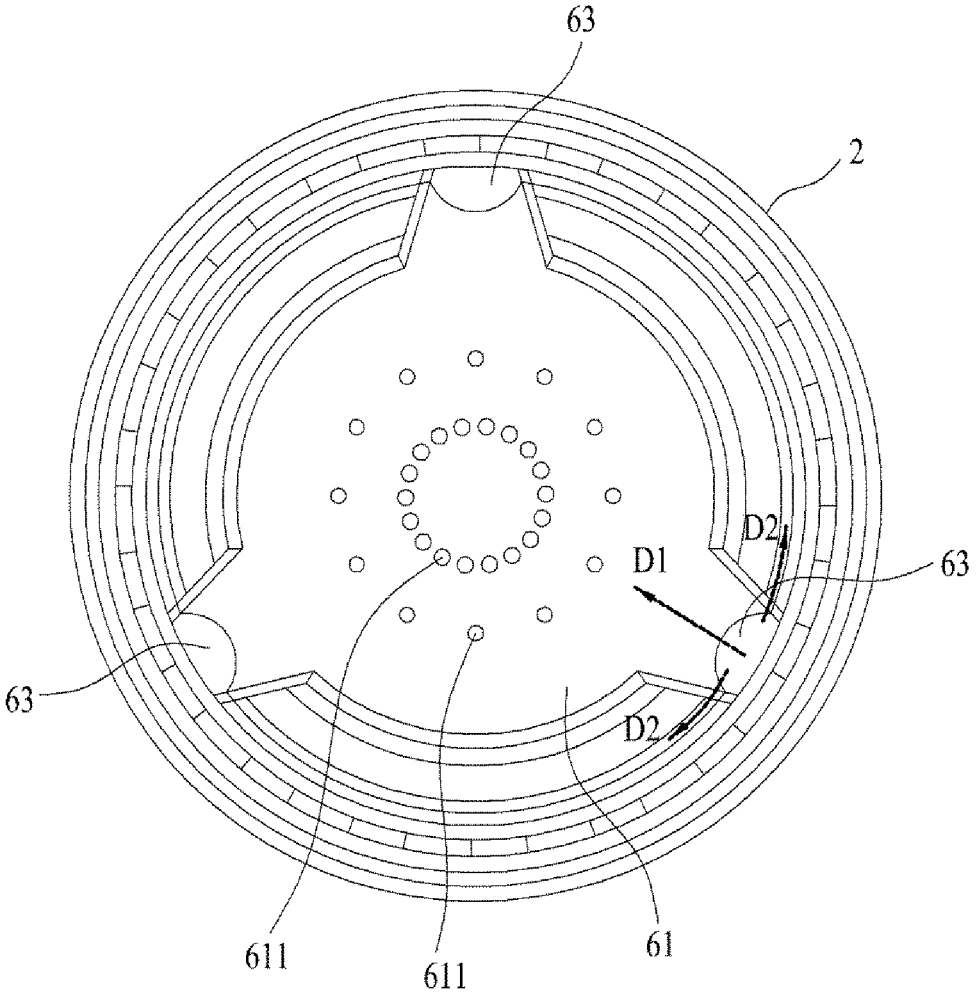
FIG. 2 is a view illustrating a drum and a discharge part provided to the laundry machine.

Referring to FIG. 2, the lifter 6 provided to the laundry machine includes a cover plate 61 arranged to surround the through holes 231 provided in the rear surface of the drum, and at least one arm 63 communicating with the cover plate 61 and arranged on the circumferential surface of the drum in the longitudinal direction of the drum.

In the case that the through holes 231 provided in the rear surface 23 of the drum are arranged in a circular form, the cover plate 61 may be formed in the shape of a cylinder having one open surface. In this case, the open surface of the cover plate 61 may be detachably fixed to the rear surface 23 of the drum.

In addition, the cover plate 61 may be provided with a plurality of cover through holes 611. Thereby, the air (non-heated air or heated air) flowing into the cover plate 61 via the air supply hole 153 and the through holes 231 may be allowed to move from the rear surface 23 of the drum toward the front surface of the drum (i.e., toward the drum opening 21).

The arm 63 not only functions as a flow passage to move the air introduced into the cover plate 61 toward the front of the drum 2 in the longitudinal direction of the drum, but also as a means to move the laundry within the drum 2 during rotation of the drum 2.

The arm 63 is arranged to protrude from the circumferential surface of the drum toward the center of rotation C of the drum. Therefore, when the drum rotates, the arm 63 may not only facilitate heat exchange between the laundry and the air by moving the laundry, but also prevent entanglement of the laundry within the drum.

A plurality of arms 63 may be provided to the circumferential surface of the drum. For example, three arms may be arranged spaced 120 degrees apart from each other, as shown in FIG. 2.

Accordingly, the air (non-heated air or heated air) introduced into the cover plate 61 via the air supply hole 153 and the through holes 231 may move from the rear surface 23 of the drum toward the front surface of the drum through the arm 63.

Meanwhile, a plurality of arm through holes 631 is arranged in the arm 63 in the longitudinal direction of the arm 63. The arm through holes 631 may be provided in the upper surface of the arm 63, or may be provided in both lateral surfaces of the arm 63 facing each other.

Figure 3:
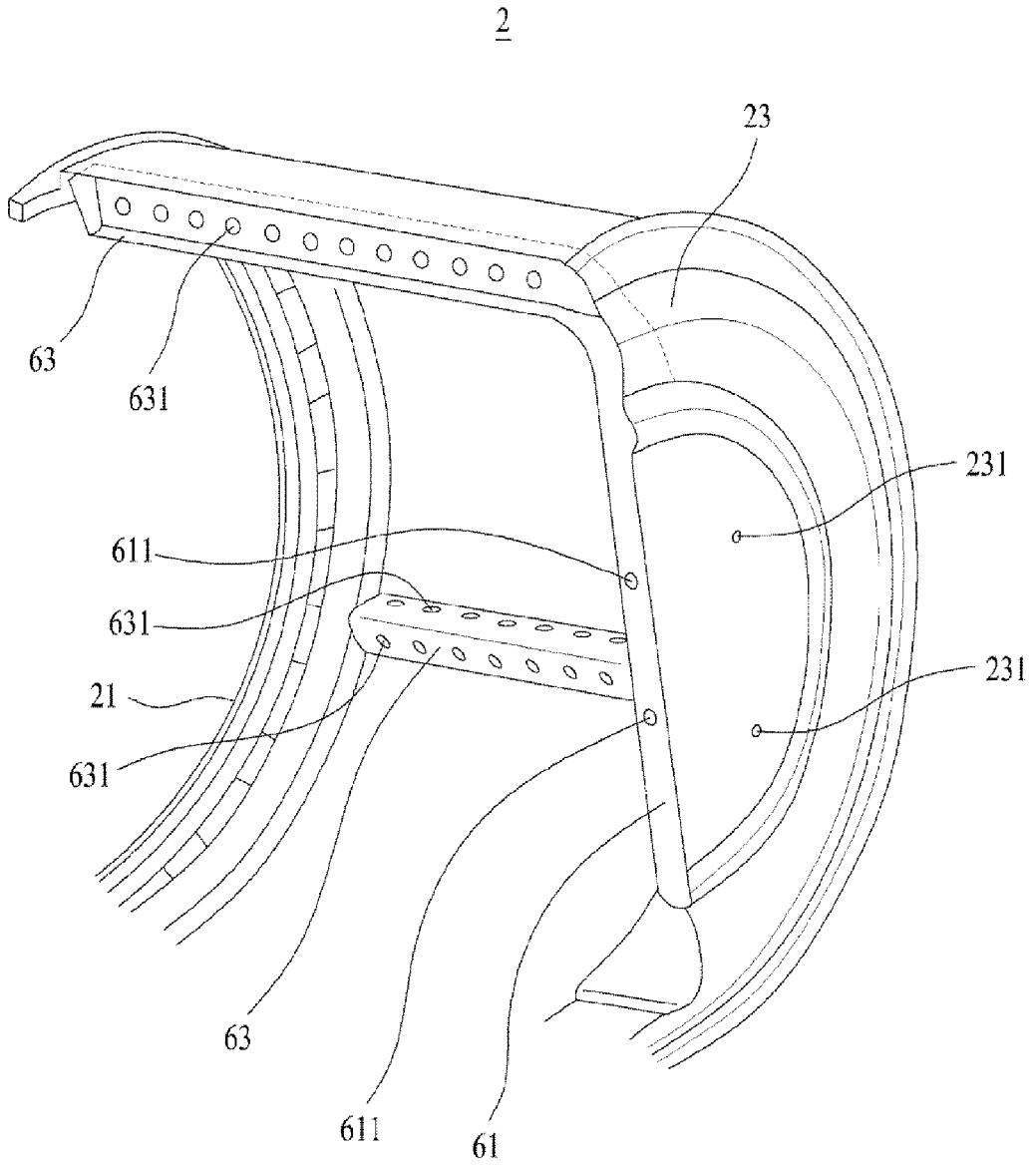
FIG. 3 is a cross-sectional view illustrating the drum and the discharge part provided to the laundry machine.

In the case that the arm through holes 631 are arranged to penetrate the upper surface of the arm 63 (not shown), the air in the arm 63 may be discharged from the circumferential surface of the drum in the direction toward the center of rotation of the drum (D1). In the case that the arm through holes 631 are arranged to penetrate both lateral surfaces of the arm 63 facing each other (see FIG. 3), the air in the arm 63 may be discharged from the circumferential surface of the drum in the circumferential direction of the drum (D2).

The lifter 6 may be integrated with the drum 2, or may be detachably provided to the drum.

In the case that the lifter 6 is integrated with the drum, the lifter 6 may be formed of the same material as that of the drum.

Meanwhile, the arm 63 provided to the lifter may be integrated with the drum, and the cover plate 61 may be detachably provided to the rear surface 23 of the drum. In this case, the cover plate 61 may be formed of a material such as plastics.

In addition, the cover plate 61 and the arm 63 may be formed to be detachable to the drum 2. In this case, the cover plate 61 and the arm 63 may be separable from each other. Thereby, ease of assembly may be improved, and maintenance operation may be facilitated.

Hereinafter, the drying process in the laundry machine 100 will be described with reference to FIG. 1.

A user opens the door 13 and then stores laundry in the drum 2 through the introduction hole 111, the supporter introduction hole 171, and the drum opening 21.

Thereafter, the user selects the drying course through an input means (not shown) for control commands provided to the control panel 113.

Once the drying course is selected, the laundry machine 100 rotates the drum 2 through the drive unit 3, operating the fan 41 and the heat exchanger 43.

When the fan 41 rotates, the air in the drum 2 is introduced into the discharge duct 4. The air introduced into the discharge duct 4 is dehumidified and heated by the heat exchanger 43. That is, the air introduced into the discharge duct 4 is cooled by a cooling means such as an evaporator (not shown) or cooling water, thereby being dehumidified. The dehumidified air is heated by a heating means such as a condenser (not shown) or a heater.

The air having been dehumidified and heated moves to the supply duct 5, which is connected to the discharge duct 4. The air in the supply duct 5 moves into the cabinet 1 through the air supply hole 153.

Since the flow passage connection part 25 is arranged between the air supply hole 153 and the rear surface 23 of the drum, the air having passed through the air supply hole 153 moves into the drum 2 through the flow passage connection part 25 and the through holes 231 in the rear surface of the drum 2.

After passing through the rear surface 23 of the drum 2, the air is supplied to the arm 63 via the cover plate 61. At this time, a part of the air is supplied to the laundry through the cover through holes 611, and the remainder of the air is discharged from the circumferential surface of the drum toward the center of rotation C of the drum or in the circumferential direction of the drum through the arm through holes 631.

The air supplied to the drum 2 through the cover through holes 611 exchanges heat with the laundry while moving from the rear surface 23 of the drum toward the front surface of the drum. Thereafter, the air moves to the discharge duct 4. The air supplied to the drum through the arm through holes 631 is directly supplied to the laundry closely contacting the inner circumferential surface of the drum to dry the laundry.

Accordingly, since the laundry machine 100 allows air to be directly supplied to the laundry closely contacting the circumferential surface of the drum, it may easily dry the laundry compared to the conventional laundry machine even when part of the laundry remains in close contact with the circumferential surface of the drum during rotation of the drum due to a small amount of the laundry.

Although not shown in the drawing, the discharge duct 4 may be provided with a filter to filter the air discharged from the drum.

As apparent from the above description, the present invention has effects as follows.

A laundry machine according to one embodiment of the present invention may provide high drying efficiency.

In addition, a laundry machine according to one embodiment is provided with a discharge part arranged in a drum accommodating laundry to cause movement of the laundry and spray air onto the laundry.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a cabinet including an introduction hole for introducing and retrieving laundry;

a drum for holding the introduced laundry, the drum being rotatable within the cabinet;

an air supply unit for supplying air to the drum;

a discharge part, provided in the drum, for discharging the supplied air from a circumferential surface of the drum toward a center of rotation of the drum and from the circumferential surface of the drum toward a circumferential direction of the drum, wherein the discharge part is a flow passage arranged in a longitudinal direction of the drum and comprises:

a cover plate fixed to a rear surface of the drum to spray the air supplied from the air supply unit toward a front surface of the drum, wherein the cover plate is formed in the shape of a cylinder having one open surface, the open surface of the cover plate being detachably fixed to the rear surface of the drum; and at least one arm in communication with the cover plate for moving the air supplied into the cover plate toward the front surface of the drum in the longitudinal direction of the drum, wherein the at least one arm is fixed to the circumferential surface of the drum for discharging the air supplied into the cover plate from the circumferential surface of the drum toward the center of rotation of the drum and from the circumferential surface of the drum in the circumferential direction of the drum, wherein arm through holes are provided in the upper surface of the arm and in both lateral surfaces of the arm facing each other, and wherein the cover plate comprises a cover through hole to supply air toward the front surface of the drum.

2. The laundry machine of claim 1, wherein the discharge part protrudes from the circumferential surface of the drum toward the center of rotation of the drum.

3. The laundry machine of claim 2, wherein the flow passage is a lifter for moving the laundry held in the drum when the drum rotates.

4. The laundry machine of claim 1, wherein:

the cabinet further comprises an air supply hole allowing the air supplied from the air supply unit to be introduced into the laundry machine;

the air supply unit comprises a discharge duct allowing the air to be discharged from the drum therethrough, a supply duct connected to the air supply hole, a fan provided in the discharge duct for discharging the air from the drum, and a heat exchanger provided in the supply duct for heating air; and the drum comprises a through hole formed in the rear surface of the drum and in communication with the cover plate, and a flow passage connection part connecting the air supply hole to the through hole.

5. The laundry machine of claim 1, wherein:

the cabinet further comprises an air supply hole allowing the air supplied from the air supply unit to be introduced into the laundry machine;

the air supply unit comprises a discharge duct allowing the air to be discharged from the drum therethrough, a supply duct having one end connected to the discharge duct and the other end connected to the air supply hole, a heat exchanger for dehumidifying and heating the air introduced into the discharge duct, and a fan for circulating the air in the drum; and the drum comprises a through hole formed in the rear surface of the drum and in communication with the cover plate, and a flow passage connection part connecting the air supply hole to the through hole.

6. The laundry machine of claim 1, wherein:

the cover through hole is arranged to surround the through hole for supplying the air introduced through the through hole toward the front surface of the drum.

7. The laundry machine of claim 1, wherein the cover plate and the arm are detachable from and attachable to each other.

8. The laundry machine of claim 1, wherein the cover plate and the arm are integrally provided to the drum.

9. The laundry machine of claim 1, wherein the at least one arm comprises a plurality of arms arranged 120 degrees apart from each other on the circumferential surface of the drum.

* * * * *